United States Patent [19]

Litkewycz

[11] 4,234,976

[45] Nov. 25, 1980

[54] FOLDABLE FURNITURE ASSEMBLY

[75] Inventor: Stanley Litkewycz, Brighton, Mich.

[73] Assignee: Lear Siegler, Inc., Detroit, Mich.

[21] Appl. No.: 963,078

[22] Filed: Nov. 22, 1978

[51] Int. Cl.[3] ..... A47C 13/00; A47C 17/14

[52] U.S. Cl. ..... 5/18 R; 5/28; 5/53 R; 297/440

[58] Field of Search ..... 5/13, 17, 18 R, 27–29, 5/30, 37 R, 37 B, 53 R; 297/440

[56] References Cited

U.S. PATENT DOCUMENTS

| | | | |
|---|---|---|---|
| 2,938,219 | 5/1960 | Hesselberg et al. | 5/13 |
| 3,482,270 | 12/1969 | Hill | 5/13 |
| 3,771,178 | 11/1973 | Inman | 5/13 |

FOREIGN PATENT DOCUMENTS

| | | | |
|---|---|---|---|
| 2377788 | 1/1977 | France | 5/13 |

*Primary Examiner*—Casmir A. Nunberg

*Attorney, Agent, or Firm*—Reising, Ethington, Barnard, Perry & Brooks

[57] ABSTRACT

A foldable sofa bed assembly is disclosed including first and second frame subassemblies, a side frame subassembly, a front frame subassembly adapted for connection to the side frame subassembly, a linkage subassembly for operatively interconnecting the first and second frame subassemblies and the side frame subassembly for moving the first and second frame subassemblies relative to each other and relative to the side frame subassembly between a folded sofa forming position and an open bed forming position. The subassemblies can be shipped in relatively narrow containers to be later assembled together. The linkage subassembly includes a plurality of pivotally connected links pivotally connected to the side frame subassembly and operable for movement between the sofa and bed forming position. The sofa bed assembly also includes a back frame subassembly adapted for connection to the side frame subassembly. The back frame subassembly includes a back wall and a backing subassembly which is pivotally connected to the back wall for movement relative thereto between a retracted storage position and an extended use position. The backing subassembly includes a plurality of interconnected back frame members pivotally connected to the back wall and capable of movement between the storage and use positions. The backing subassembly provides at least a partial support for a back cushion in the use position.

19 Claims, 6 Drawing Figures

FOLDABLE FURNITURE ASSEMBLY

TECHNICAL FIELD

This invention relates to foldable furniture assemblies and in particular to foldable furniture assemblies having subassemblies which can be shipped without being connected together to be easily connected together at a later time.

BACKGROUND ART

Prior patents disclose foldable sofa bed assemblies having linkage mechanisms provided for shifting folded bed frames into and out of a base structure and for stablizing the bed frames securely in its two positions of use. For example, the U.S. Pat. No. of Inman 3,771,178 discloses a linkage mechanism which is connected to a base means and is adapted for connection to two frame means to be operable for movement between the sofa and bed forming positions without being connected to the two frame means. Likewise, the U.S. Pat. No. of Hill 3,482,270 discloses a daveno bed provided with a raising and lowering mechanism having a cross shaft and a tie rod extending across the width of the bed frame and which interconnects the main supporting pivotal arms.

This invention relates to a foldable sofa bed assembly of the type which is normally in the sofa forming position whereby it may be utilized for seating but may be unfolded for a bed forming position so that it may be utilized as a bed. Such assembly typically includes at least two frame subassemblies which are pivotly connected together and which are generally coplanar for supporting a mattress when in the bed forming position.

The prior art sofa bed assemblies typically include some sort of base frame which is adapted for attachment to a wooden frame of a piece of furniture. Various linkage mechanisms are utilized for interconnecting the two bed forming frames with the base frame to accommodate movement of the two bed forming frames between the bed forming position and the sofa forming position. These linkage mechanisms include a significant number of links which are normally pivotally connected to one another and to the two bed forming frames. Typically the manufacturers of such assemblies must attach linkages to the base frame and to the two bed forming frames for shipping the entire assembly to the customer when installed into the furniture frame which is also shipped to customer. Thereafter the manufacturer applies the upholstery. Most assemblies have therefore been shipped with the linkages attached to the bed forming frames. The assemblies are shipped in the sofa forming position where the bed forming frames overlie and are spaced vertically from one another. The space between the vertically separated bed forming frames during shipment is wasted and costly shipping space results.

The manufacturers of such assemblies also typically ship the back frame subassembly fully assembled ready for the attachment of upholstery including a back cushion. However, the configuration of the back frame assembly when so assembled also causes a waste of shipping space which is costly.

DISCLOSURE OF THE INVENTION

An object of the present invention is to provide a foldable furniture assembly which includes first and second frame means, a side frame means, and a front frame means adapted for connection to the side frame means and linkage means for operatively interconnecting the first and second frame means and the side frame means to move the first and second frame means relative to each other and relative to the side frame means between a folded sofa forming position and an open bed forming position, with the linkage means including the plurality of pivotally interconnected links pivotally connected to the side frame means and operable for movement between the sofa and the bed forming positions independently of being connected to either of the first and second frame means whereby the first and second frame means may be shipped disconnected from the linkage means while the linkage means may be easily connected to the first and second frame means after shipment.

Another object of this invention is to provide a foldable sofa bed assembly including a back frame means adapted for connection to a side frame means wherein the back frame means includes a back wall means and a backing means operatively connected to the back wall means for movement relative thereto between a retracted storage position and an extended use position and wherein the backing means includes a plurality of interconnected back frame members pivotally connected to the back wall means and which is capable of moving between the storage and use positions. The backing means provides at least a partial support for a back cushion in the use position.

A further object of the invention is to provide a foldable sofa bed assembly including a back frame means having a back wall means and a backing means operatively connected to the back wall means for movement relative thereto between a retracted storage position and an extended use position wherein the back wall means includes a support rail and the backing means includes a support member spaced from and substantially parallel to the support rail and wherein the assembly further includes spring means which extends between the support rail and the support member to provide a resilient support for a back cushion.

In carrying out the above objects and other objects of this invention a preferred embodiment of a foldable furniture assembly constructed in accordance with this invention comprises first and second frame means, side frame means, front frame means adapted for connection to the side frame means, linkage means for operatively interconnecting the first and second frame means and the side frame means to move each of the first and second frame means relative to each other and relative to the side frame means between a folded position and an open position. The linkage means includes a plurality of pivotally connected links pivotally connected to the side frame means and capable of movement between the folded and open positions. The assembly also comprises a back frame means adapted for connection to the side frame means. The back frame means includes back wall means and backing means operatively connected to the back wall means for movement relative between a retracted storage position and an extended use position. The backing means includes a plurality of interconnected back frame members pivotally connected to the back wall means and capable of movement between the storage and the backing position. The backing means provides at least a partial support for a back cushion in the use position.

The objects, features, and advantages of the present invention are readily apparent from the following detailed description of the best mode taken in connection with the accompanying drawings.

BEST MODE FOR CARRYING OUT THE INVENTION

Figure 6:
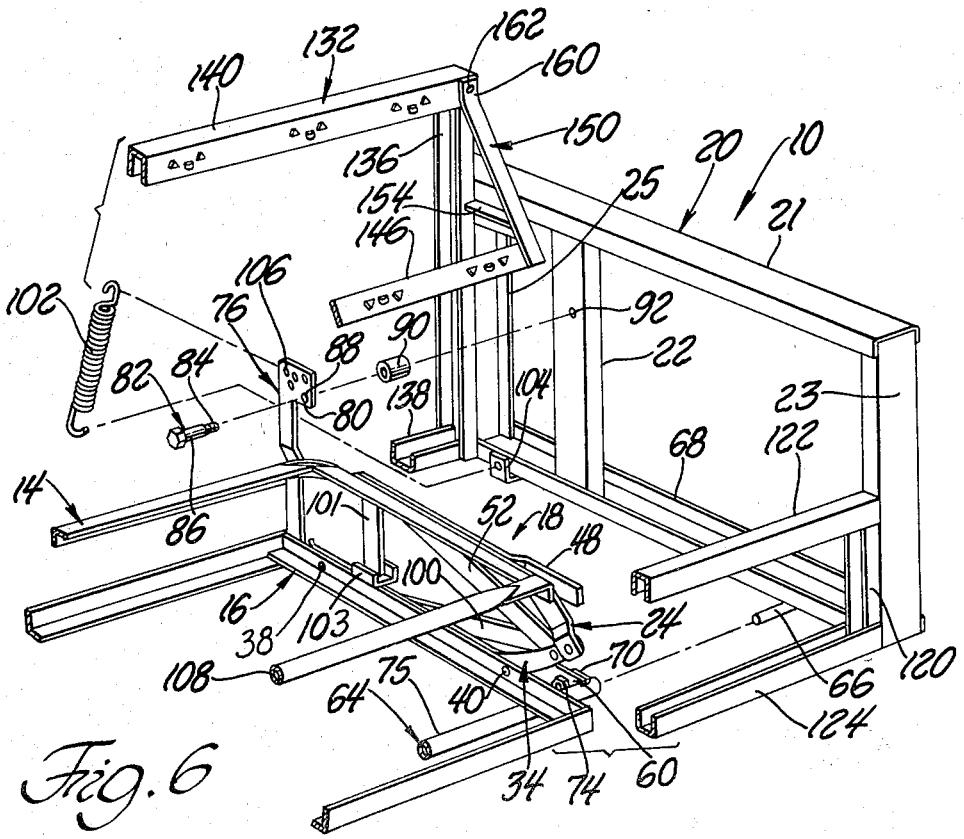
FIG. 6 is a fragmentary exploded perspective view showing one end of a preferred embodiment of the foldable sofa bed assembly.

Referring now to the drawings, a preferred embodiment of the foldable sofa bed assembly constructed in accordance with the invention is generally shown at 10 in FIG. 6. In all the FIGURES only one end of the assembly 10 is illustrated; however, the other end is the same but opposite in configuration; thus only one end will be described.

Figure 5:
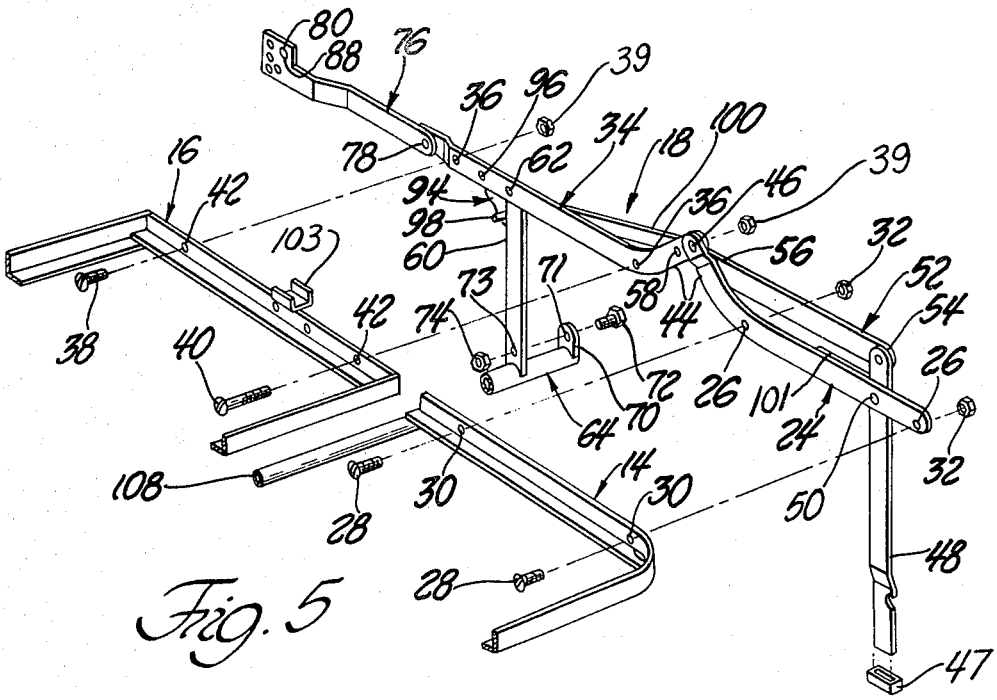
FIG. 5 is a fragmentary exploded perspective view showing one end of a subassembly to be combined with the subassembly of FIG. 1.

Referring now to FIG. 5, the sofa bed assembly 10 includes a first frame means or subassembly generally indicated at 14 and a second frame means or subassembly generally indicated at 16. The first frame subassembly 14 is sometimes referred to as a foot frame and the second frame subassembly 16 is sometimes referred to as a head frame. The two frame subassemblies 14 and 16 are completely separated in the bed forming position illustrated in FIG. 5. Springs, canvas or the like may be stretched between the structural members defining each of the frame subassemblies 14 and 16 for supporting a mattress.

The assembly 10 also includes a linkage means or linkage subassembly generally indicated at 18 in FIGS. 5 and 6. The linkage subassembly 18 operatively interconnects the first and second frame subassemblies 14 and 16 and a side frame means or side frame subassembly generally indicated at 20 to move the first and second frame subassemblies 14 and 16 relative to each other and relative to the side frame subassembly 20 between a folded sofa forming position as shown in FIG. 6 and an open bed forming position as shown in FIG. 5. As illustrated in FIG. 6, when in the sofa forming position, the first frame subassembly 14 is disposed above the second frame subassembly 16 for forming the seat of the sofa.

The linkage subassembly 18 includes a plurality of pivotally interconnected links connected to a vertical frame member 22 of the side frame subassembly 20 and are operable for movement between the sofa and the bed forming positions, independent of being connected to either of the frame subassemblies 14 or 16. In other words, the links forming the linkage subassembly 18 may be sequenced between the sofa and bed forming position without being attached to the first and second frame subassemblies 14 and 16, respectively. The linkage subassembly 18 forms an operable mechanism in and of itself which need not be connected to the frame subassemblies 14 and 16 to complete the mechanism. Thus there is no problem in shipping the linkage subassembly 18 independently of being connected to the frame subassemblies 14 and 16 and independently of being connected to the side frame subassembly 20. Thus a great deal of space is conserved during shipment and yet allow easy assembly of the linkage subassembly 18 to the frame subassemblies 14 and 16 and the side frame subassembly 20 without first having to understand how the linkage subassembly 18 operates or in what positions the various links should be for attachment to the frame subassemblies 14 and 16 and to the side frame assembly 20.

The linkage subassembly 18 includes a first link generally indicated at 24 adapted by holes 26 formed therethrough for rigid nonpivotal connection to the first frame subassembly 14. Two spaced fasteners comprising threaded bolts 28 connect the first link 24 to the first frame subassembly 14 by extending through the holes 26 in the first link 24 and through holes 30 formed through the first frame subassembly 14. The bolts 28 are secured in the holes 26 and 30 by locking nuts 32.

The linkage subassembly 18 also includes a second link generally indicated at 34 adapted by holes 36 for rigid nonpivotal connection to the second frame subassembly 16. Two spaced fasteners comprising threaded bolts 38 and 40 connect the second link 34 to the second frame subassembly 16 by extending through the holes 36 in the second link 34 and through holes 42 in the second frame subassembly 16. The bolts 38 and 40 are secured in the holes 36 and 42 by locking nuts 39.

The bolts 28, 38 and 40 connect the first and second links 24 and 34 to their respective first and second frame subassemblies 14 and 16 to prevent first and second links 24 and 34 from pivoting or rotating or otherwise moving relative to the frame subassemblies 14 and 16 when connected thereto. The linkage subassembly 18 has integrity as an operative mechanism independently of being connected to the first and second frame subassemblies 14 and 16 by being pivotally connected at at least two spaced points to the other links of the linkage subassembly 18.

The first and second links 24 and 34 each have an upwardly extending arm 44 as viewed in the bed forming position of FIG. 5. The subassembly 18 includes a pivot means or rivet 46 for pivotally interconnecting the first and second links 24 and 34 at their arms 44 whereby when the first and second links 24 and 34 are attached to the first and second frame subassemblies 14 and 16, respectively, the first and second frame subassemblies 14 and 16 become pivotally interconnected. When the linkage subassembly 18 is pivoted from the bed forming position to the sofa forming position, the link 24 and consequently the plane of the first frame subassembly 14 will be spaced above and parallel to the second link 34 as well as to the second frame subassembly 16.

The linkage subassembly 18 includes a leg link 48 which is pivotally connected at 50 to the first link 24. The leg link 48 along with the other links to be described hereafter supports the first and second frame subassemblies 14 and 16 in the bed forming position as illustrated in FIG. 5 wherein the bottom of the leg link 48 is disposed in a leg support 47. The leg link 48 extends downwardly from the first link 24 and upwardly from the first link 36 when in the bed forming position.

The linkage subassembly 18 further includes a drive link generally indicated at 52 pivotally connected at one end 54 to the upper end of the leg link 48 which is above the pivotal connection at 50 when in the bed forming position. The drive link 52 is pivotally connected at its other end 56 by a rivet 58 to the second link 34 for controlling the position of the leg link 48 during movement between the sofa and bed forming positions.

The linkage subassembly 18 also includes a support link 60 which in the bed forming position is pivotally connected at an upper end at 62 to the second link 34. The lower end of the support link 60 is secured to a bracket generally indicated at 64. The support link extends from the curved outer surface of a hollow shaft 75 of the bracket 64. The lower end of the support link 60 is secured at the curved outer surface by an upwardly projecting flange 70 of the bracket 64 by a fastener 72 which comprises a threaded bolt which extends through holes 71 and 73 formed through the flange 70 and the support link 60, respectively, and is held in place by a nut 74.

A rod 66 is fixedly mounted, such as by welding, at and extends from the lower surface of the bottommost frame member 68. The bracket 64 is pivotally supported on the rod 66 by placing the shaft 75 over the rod 66. Thus the lower end of the support link 60 is pivotally connected to the side frame subassembly 20 at one location.

As alluded to hereinbefore, a linkage subassembly like the linkage subassembly 20 but of the opposite mirror image is disposed at the other end of the first and second frame subassemblies 14 and 16 and the shaft 75 of the bracket 64 extends between the two linkage subassemblies. During shipment the bolt 72 is disconnected to disconnect the support link 60 from the bracket 64. However, when the linkage subassembly 18 and the opposite linkage subassembly are connected by the bracket 64 to the side frame subassemblies both are operable for movement between the sofa and bed forming positions independently of being connected to the first and second frame subassemblies 14 and 16.

The linkage subassembly 18 further includes a guide link generally indicated at 76 pivotally connected at 78 at one end of the second link 34 and pivotally connected at its other end at 80 to the vertical frame member 22 of the side frame subassembly 20. The pivotal connection at 80 is accomplished through a fastener generally indicated at 82 which comprises a bolt having a threaded portion 84 and a smooth cylindrical portion 86. The bolt 82 extends through an aperture 88 formed through the guide link 76 at 80, through a spacer means or apertured collar member 90 and through an aperture 92 formed through the vertical frame member 22 to be fixedly secured within the frame member 22 by a weld nut (not shown). The pivotal connection at 80 of the guide link 76 to the vertical frame member 22 is at a position horizontally displaced but vertically above the pivotal connection of the support link 60 to the bracket 64. This is important because the guide link 76 hangs generally vertically downwardly from the pivot 80 when the assembly is in the sofa forming position.

The linkage subassembly 18 also includes a stop link generally indicated at 94 pivotally connected at 96 to the second link 34. The stop link 94 includes a stop 98 extending inwardly therefrom to engage the support link 60 in the bed forming position.

The linkage subassembly 18 also includes a control link 100 pivotally connected to the drive link 52 (not shown) and to the stop link 94 for moving the stop 98 of the stop link 94 into engagement with the support link 60 in the bed forming position to prevent pivotal movement of the second link 34 about its pivotal connection at 62 without relative pivotal movement between the first and second links 24 and 34.

The linkage subassembly also includes a support link 101 pivotally connected at 50 to the first link 24 and leg link 48. The support link 101 is disposed in a bracket 103 fixedly mounted on the top surface of the second frame subassembly 16 in the sofa forming position to further provide support.

A spring 102 reacts and extends between a bracket 104 fixedly mounted on the bottom surface of the frame member 68 and an aperture 106 formed through the guide link 76. The spring 102 assists in raising the subassemblies from the sofa forming position to the bed forming position.

The first frame subassembly 14 also includes an integrally formed hollow arm 108 which extends the length of the first frame subassembly 14. The arm 108 provides further support for either a mattress in the bed forming position or a cushion in the sofa forming position.

Figure 1:
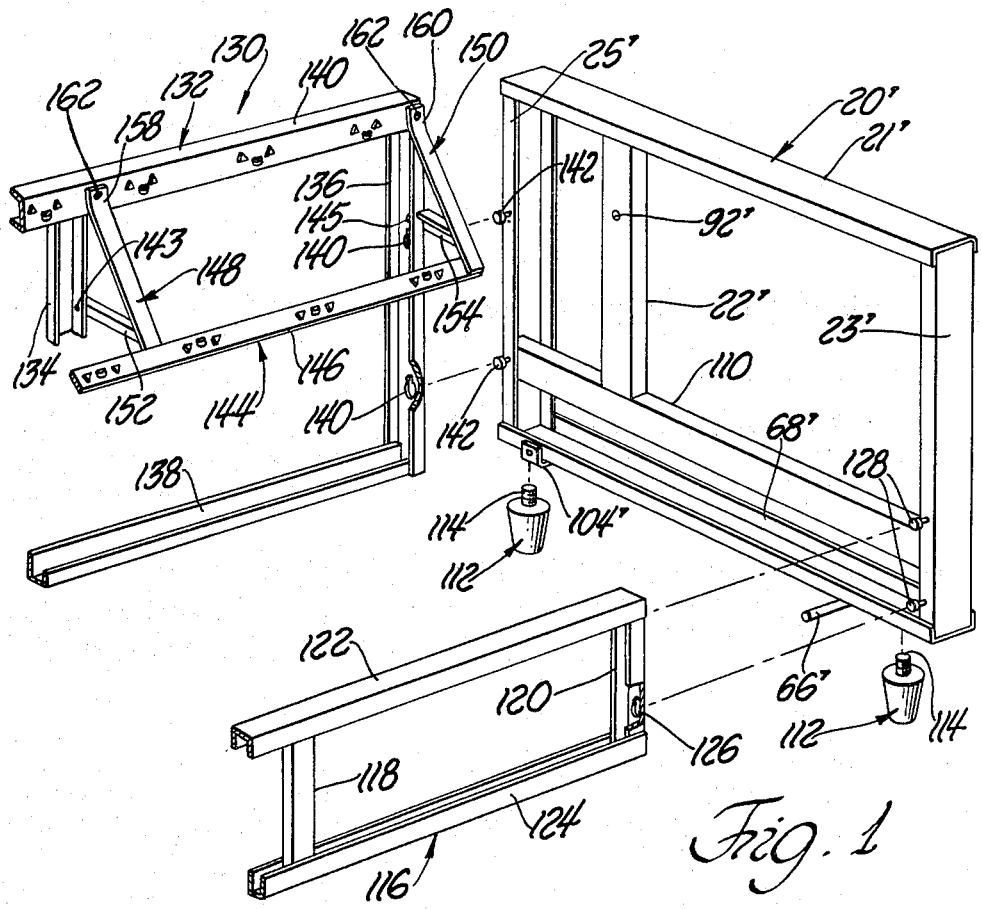
FIG. 1 is a fragmentary exploded perspective view showing one end of an embodiment of a subassembly of the foldable sofa bed assembly of the invention.

Referring now to FIG. 1 there is generally shown a second embodiment of a side frame subassembly generally indicated at 20'. The side frame subassembly 20' includes a vertical frame member 22' which extends between and interconnects a top frame member 21' and a horizontal frame member 110. The vertical frame member 22' includes an aperture 92' adapted for receiving a threaded fastener such as the bolt 82 as shown in FIG. 6. The side frame subassembly 20' also includes side frame members 23' and 25' which extend between the top frame member 21' and a bottom frame member 68' for supporting the frame members 21', 22' and 110.

The side frame subassembly 20' further includes an apertured bracket 104' and a rod 66' both fixedly mounted at the bottom surface of the bottom frame member 68'. The side frame subassembly 20' further includes a pair of spaced legs generally indicated at 112 which are screwedly attached at the bottom surface of the bottom frame members 68' at threads 114.

The assembly also includes a front frame means or subassembly generally indicated at 116 and which comprises vertical frame members 118, 120 and interconnecting horizontal frame members 122 and 124. The front frame subassembly 116 is adapted at the vertical frame member 120 for connection to the side frame subassembly 20' or to the side frame subassembly 20 by keyhole aperture 126, only one of which is shown in FIG. 1. Threaded bolts 128 secure the subassembly 116 to the subassembly 20' after shipping and after upholstery has been positioned over the subassembly 116 to form the front of the assembly.

Also shown in FIG. 1 is a back frame means or back frame subassembly generally indicated at 130. The subassembly 130 includes a back wall means or back wall generally indicated at 132 including vertical frame members 134 and 136 and an interconnecting bottom frame member 138 and an interconnecting top support rail 140. The back frame subassembly 130 is adapted at its vertical frame member 136 by keyholes 140 to be connected to the side frame subassembly 20' or to the side frame subassembly 20 by bolts 142 after shipping in the same fashion as the front frame subassembly 116 is secured to the side frame subassembly 20' or 20 after shipping.

Figure 2:
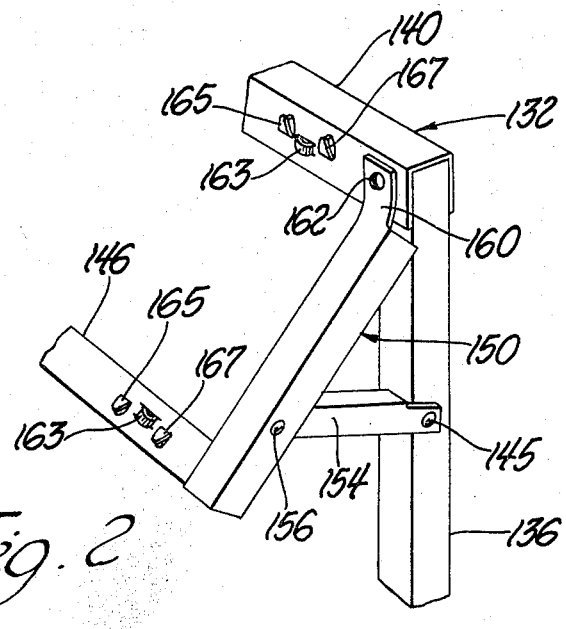
FIG. 2 is a fragmentary perspective view showing one end of a back frame subassembly of the assembly shown in FIG. 1 in its extended backing position.

The back frame subassembly 130 also includes a backing means or backing subassembly generally indicated at 144. The backing subassembly 144 which extends the length of the back frame subassembly 130, and is shown in greater detail in FIGS. 2, 3, and 4, includes a plurality of interconnected back frame members pivotally connected to the vertical frame members 134 and 136 at 143 and 145, respectively, by rivets. The back frame members of the backing subassembly 144 include a support member 146 which is spaced from and extends substantially parallel to the support rail 140 by interconnected first frame members generally indicated at 148 and 150 and second frame members 152 and 154 of the back frame members.

Figure 3:
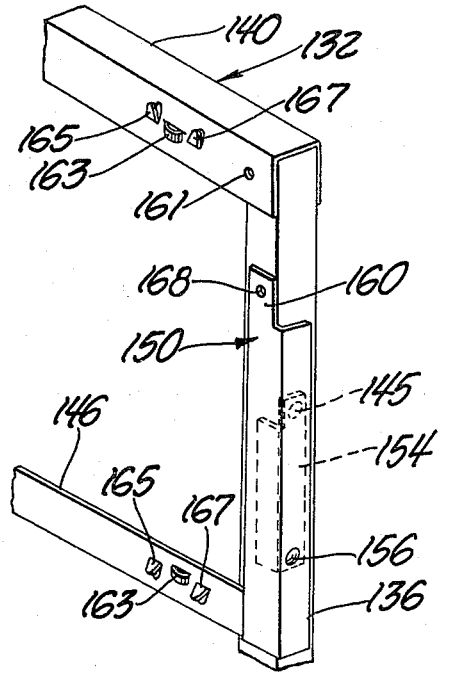
FIG. 3 is a fragmentary perspective view of the back frame subassembly of FIG. 2 shown in its retracted storage position.

The backing subassembly 144 is shown in its extended position in FIGS. 1, 2, 4 and 6 and in its retracted storage position in FIG. 3. The second frame members 152 and 154 of the backing subassembly 144 are pivotally connected to the back wall 132 and are capable of moving the rest of the back frame members 146, 148 and 150 between the storage and backing positions to provide at least a partial support for a back cushion (not shown) when in the backing position.

The support member 146 is fixedly connected to the first frame members 140 and 150, at one of their ends, for example by welding. The first frame member 148 and 150 are pivotally connected at their same ends to the second frame members 152 and 154, respectively, at 156 by rivets.

The first frame members 148 and 150 include upwardly extending integral flanges 158 and 160, respectively, through which threaded screws 162 extend at holes 168 to provide a rigid nonpivotal connection to the support rail 140 at apertures 161 in the extended backing position.

The second frame members 152 and 154 are pivotally connected at 143 and 145, respectively, to the vertical frame members 134 and 136 to allow the back frame subassembly 130 to be shipped in the retracted storage position shown in FIG. 3. In the storage position, the back frame members 150, 146 and 154, as shown in FIG. 3, as well as first and second frame members 148 and 152 are disposed adjacent to and abuttingly engage their corresponding vertical frame members 136 and 134, respectively, of the back wall 132. The rivets which provide the pivotal connections at 156, 145 and 143 allow the first frame members 148 and 150 and the second frame members 152 and 154 to pivot upwardly from the storage position to the backing position, the support member 146 being rigidly carried thereby. At the same time, the flanges 151 and 160 are bent such that the holes 168 and the apertures 161 are aligned to screw and the screws 162 therethrough.

Both the support members 146 and the support rail 140 have a plurality complementary tongue and tunnel clips formed thereon which define a retainer means for mounting a spring means or a plurality of spiral springs therebetween (one of which is indicated at 164). Each of the opposite ends of the spiral spring 164 extends through its corresponding tunnel clip 163 and is secured therein by a first set of tongue clips 165 which are bent over the ends of the spiral spring 164 after the ends of the spiral spring 164 have been positioned in their corresponding tunnel clips 163.

Figure 4:
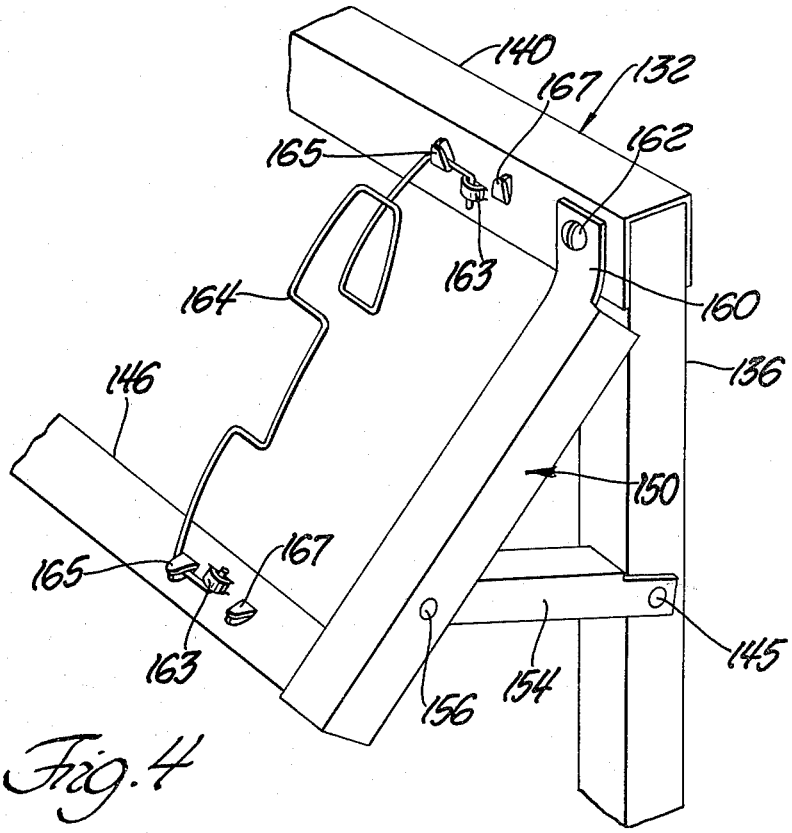
FIG. 4 is a slightly enlarged fragmentary perspective view of the back frame assembly of FIG. 2 including a spring means secured thereto.

The spiral springs are mounted to the support rail 140 and the support member 146 in the backing position after shipment to provide a resilient support for the back cushion and thereafter upholstery is placed over back frame subassembly 130. A second set of tongue clips 167 is provided to cooperate with its corresponding adjacent tunnel clip 163 if it is desired to secure the spiral spring 164 at that position. In other words, the tongue clips 167 will secure the spiral spring 164 in the tunnel clips 163 if the spiral spring 164 is rotated 180° from its position as shown in FIG. 4, the spiral spring 164 being disposed within the tongue clips 167.

While a preferred embodiment of the furniture assembly has been shown and described herein in detail, those skilled in this art will recognize various alternative designs and embodiments for practicing the present invention as defined by the following claims.

What is claimed is:

1. A foldable furniture assembly comprising:

first frame means, second frame means, side frame means, front frame means adapted for connection to said side frame means, linkage means for operatively interconnecting said first frame means to said second frame means and for operatively interconnecting said first and second frame means to said side frame means so that each of said first and second frame means are all able to move relative to each other and relative to said side frame means between a folded position and an open position, said linkage means including a plurality of pivotally connecting links pivotally connected to said side frame means and capable of movement between said folded and open positions, and back frame means adapted for connection to said side frame means, said back frame means including back wall means and backing means operatively connected to said back wall means for movement relative thereto between a retracted storage position and an extended use position, said backing means including a plurality of interconnected back frame members pivotally connected to said back wall means and capable of movement between said storage and use positions, said backing means providing at least a partial support for a back cushion in said use position.

2. The assembly as claimed in claim 1 wherein said back wall means includes a support rail and said back frame members include a support member spaced from and substantially parallel to said support rail and wherein said assembly further comprises spring means extending between said support rail and said support member to provide a resilient support for the back cushion.

3. The assembly as claimed in claim 2 wherein said back frame means includes retainer means on said support rail and said support member for mounting said spring means to said support rail and said support member.

4. The assembly as claimed in claim 3 wherein said spring means includes at least one connected spring, said retaining means including a plurality of clips disposed on said support rail and said support member for holding the ends of said spiral spring therebetween.

5. The assembly as claimed in claim 2 or claim 4 wherein said backing means includes at least one first frame member adapted for rigid nonpivotal connection at one end thereof to said support rail in said use position, said support member being connected at the opposite end thereof.

6. The assembly as claimed in claim 5 wherein said backing means includes at least one second frame member pivotally connected to said back wall means and to the opposite end of said first frame member at two spaced points to allow said first frame member and said support member to pivotally move from said storage position to said use position and wherein said assembly includes fastener means for rigidly connecting said first frame member to said support rail in said use position.

7. The assembly as claimed in claim 6 wherein said first frame member includes an integral flange portion and wherein said fastener means extends through said flange portion to rigidly connect said first frame member to said support rail.

8. The assembly as claimed in claim 1 or claim 7 wherein said side frame means includes a vertical frame member and wherein said assembly includes pivot means for pivotally connecting one of said plurality of links to said vertical frame member.

9. The assembly as claimed in claim 8 wherein said pivot means includes spacer means extending between said one of said plurality of links and said vertical frame member for spacing said plurality of links from said vertical frame member.

10. The assembly as claimed in claim 9 wherein said pivot means further includes means fixedly connected to said vertical frame member and extending through an aperture formed through said spacer means for pivotally connecting said one of said plurality of links to said vertical frame member.

11. A back frame assembly for use with a first frame means, a second frame means, a side frame means, a front frame means adapted for connection to the side frame means, and a linkage means for operatively interconnecting the first frame means to the second frame means and for operatively interconnecting the first and second frame means to the side frame means, the assembly adapted for connecting to the side frame means, the assembly comprising:

back wall means, and backing means operatively connected to said wall means for movement relative thereto between a retracted storage position and an extended use position, said backing means including a plurality of interconnected back frame members pivotally connected to said wall means and capable of movement between said storage and use positions, said backing means providing at least a partial support for a back cushion in said use position.

12. The assembly as claimed in claim 11 wherein said back wall means includes a support rail and said back frame members include a support member spaced from and substantially parallel to said support rail and wherein said assembly further comprises spring means extending between said support rail and said support member to provide a resilient support for the back cushion.

13. The assembly as claimed in claim 12 wherein said back frame means includes retainer means on said support rail and said support member for mounting said spring means to said support rail and said support member.

14. The assembly as claimed in claim 13 wherein said spring means includes at least one convoluted spring, said retaining means including a plurality of clips disposed on said support rail and said support member for holding the ends of said spiral spring therebetween.

15. The assembly as claimed in claim 12 or claim 14 wherein said backing means includes at least one first frame member adapted for rigid nonpivotal connection at one end thereof to said support rail in said use position, said support member being connected at the opposite end thereof.

16. The assembly as claimed in claim 15 wherein said backing means includes at least one second frame member pivotally connected to said back wall means and to the opposite end of said first frame member at two spaced points to allow said first frame member and said support member to pivotally move from said storage position to said use position and wherein said assembly includes fastener means for rigidly connecting said first frame member to said support rail in said use position.

17. The assembly as claimed in claim 16 wherein said first frame member includes an integral flange portion and wherein said fastener means extends through said flange portion to rigidly connect said first frame member to said support rail.

18. A back frame assembly for use with a side frame means and a front means adapted for connection to the side frame means, the assembly being adapted for connection to the side frame means, the assembly comprising:

back wall means including a support rail, backing means operatively connected to said back wall means for movement relative thereto between a retracted storage position and an extended use position, said backing means including a plurality of interconnected back frame members including a support member pivotally connected to said wall means and capable of movement between said storage and use positions, and spring means extending between said support rail and said support member, said backing means and said spring means providing at least a partial resilient support for a back cushion in said use position.

19. A foldable furniture assembly comprising:

side frame means, front frame means adapted for connection to said side frame means, and back frame means adapted for connection to said side frame means, said back frame means including back wall means and backing means operatively connected to said back wall means for movement relative thereto between a retracted storage position and an extended use position, said backing means including a plurality of interconnected back frame members pivotally connected to said back wall means and capable of movement between said storage and use positions, said backing means providing at least a partial support for a back cushion in said use position.

* * * * *